US005983393A

United States Patent [19]

Walton

[11] Patent Number: 5,983,393

[45] Date of Patent: Nov. 16, 1999

[54] FLEXIBLE TOP

[76] Inventor: Gloria J. Walton, 1605 S. Ocean Blvd., Suite 704, Myrtle Beach, S.C. 29578

[21] Appl. No.: 09/150,994

[22] Filed: Sep. 10, 1998

[51] Int. Cl.[6] ..... A41B 1/00

[52] U.S. Cl. ..... 2/69; 2/67

[58] Field of Search ..... 450/86, 88, 79, 450/80, 15, 41, 52, 53, 58; 2/73, 105, 106, 113, 114, 115, 67

[56] References Cited

U.S. PATENT DOCUMENTS

| | | | |
|---|---|---|---|
| 2,440,426 | 4/1948 | Barlow et al. | 450/86 |
| 2,482,953 | 9/1949 | Waters | 450/86 |
| 2,511,641 | 6/1950 | Kuhn | 450/80 |
| 3,465,754 | 9/1969 | Lockwood et al. | 450/86 |
| 5,797,786 | 8/1998 | Smith et al. | 450/1 |

*Primary Examiner*—Gloria M. Hale
*Attorney, Agent, or Firm*—B. Craig Killough

[57] ABSTRACT

An article of wearing apparel for covering the breasts. A neck strap extends behind the neck of the wearer and extends downwardly at opposite ends so that a void is present between the ends on the front of the wearer. A cover is suspended from the neck strap and provides covering for the breasts of the wearer, while exposing the portion of the body between the breasts. A back strap connects the ends of the neck strap and is positioned around the back of the wearer.

16 Claims, 2 Drawing Sheets

FLEXIBLE TOP

BACKGROUND OF THE INVENTION

The present invention, Flexible Top, is summer wear for girls and women. This top is made of stainless steel, fabric and elastic. The flexible top makes no connection across the front, thus revealing the sexy area between the breast. This top connects behind the neck and back only.

Top connecting across the front are common. Women want to be and look differently from other women. Because a woman's body is shaped differently, nothing speaks uniqueness clearly then exposing the area between the breast. Flexible top not only emphasizes uniqueness, but is comfortable, simple to put on, and sexy.

BRIEF SUMMARY OF THE INVENTION

The general idea of the Flexible Top is to promote uniqueness between women. This top is unique in appearance (i.e., it makes no connection across the front). A primary advantage is that the top allows women to be different by showing their body differences, i.e., the area between the breast. Flexible Top also conforms to various body sizes, gives an illusion of being strapless, and is very comfortable.

DETAILED DESCRIPTION OF THE PREFERRED EMBODIMENT

Figure 1:
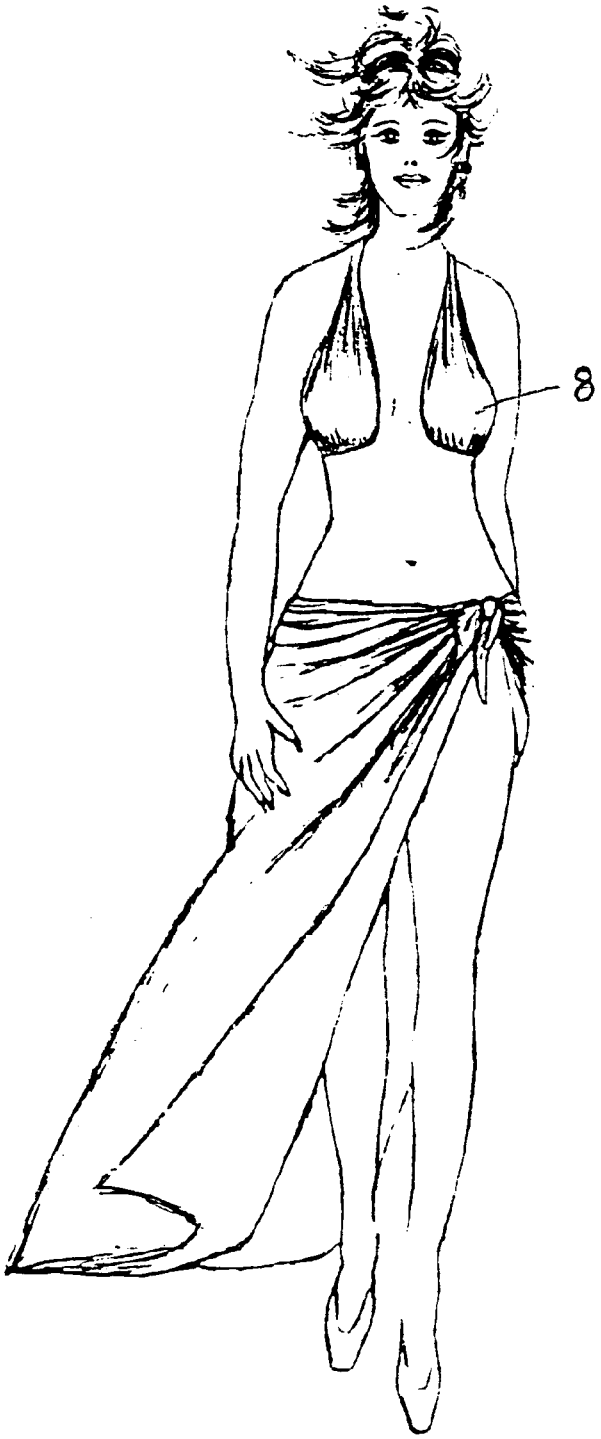
FIG. 1 is a frontal view of the garment worn on a wearer.
Figure 2:
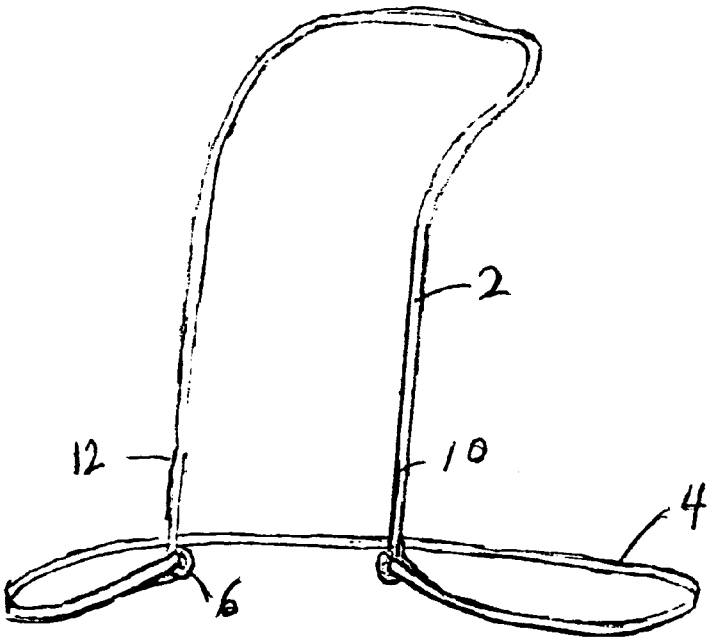
FIG. 2 is a skeleton view of the top. Part 1A is the 0.09 spring stainless steel. Part 1B is the lightweight clear elastic strap.
Figure 3:
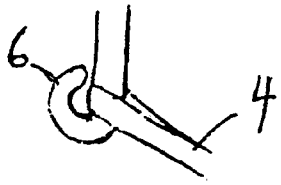
FIG. 3 shows that parts 1A and 1B are detachable for washing purposes.

Referring now to the drawing figures, a distinguishable feature of the invention is that there is a void between the breasts of the wearer. FIG. 1. The neck strap 2 is preferred to be made of a spring material, which may be stainless spring steel. The back strap 4 is preferred to be made of elastic material, which may be clear. In an embodiment of the device, the neck strap may be 34 inches long and formed as shown in FIG. 2 of 0.09 spring stainless steel. The resulting neck strap is shaped to comfortably around the neck, and may be curved at the upper portion of the neck strap. Fasteners 6 are present and are be used to hook the back strap to the neck strap. The fasteners may be hooks which are present at each end of the neck strap. The elastic may be approximately 25 inches before stretching. The elastic is attached at each end to the hook of the neck strap.

A cover 8 or garment is positioned over the neck strap to form a covering for each breast as shown in FIG. 1. The cover may be is formed by cutting to shape using a pattern, and then attached to the neck strap by slidable engagement with the neck strap. The attachment of the back strap to the neck strap assists in holding the garment in place on the neck strap. Slidable engagement of the cover relative to the neck strap allows the cover to be removed from the neck strap and elastic for the purpose of washing.

A void is present between a first end or prong 10 of the next strap, and a second end or prong 12 of the neck strap. The back strap engages the neck strap along the ends or prongs of the neck strap so as to leave a void between the ends or prongs of the neck strap. The back strap surrounds the back of the wearer but is not present between the ends or prongs of the neck strap in the front so that the area between the breasts is open as shown in FIG. 1. The neck strap 2 is a spring material, such as spring steel, so that it may be pulled apart and the wearer may enter the device. The stainless steel neck strap of one embodiment is flexible, but strong enough to allow the garment to be pulled over the breasts. The back strap may be made of elastic material which allows stretching to multiple times its original length to allow the wearer to slide her arms through the top. The elastic is resistant to perspiration, body oils, and general solvents.

What I claim as my invention is:

1. An article of wearing apparel, comprising:

a. a neck strap having generally an inverted U shape, said neck strap having an upper curved portion and first end and a second end extending downwardly from said upper curved portion;

b. a back strap which engages said neck strap along said first end and along said second end, wherein said back strap is not present on a front side of said neck strap between said first point and said second point so that a void is present between said first end and said second end; and c. a breast cover which engages said neck strap.

2. An article of wearing apparel, comprising:

a. a neck strap having a curved upper portion which extends behind a neck of a wearer, said neck strap having a first prong which extends from and below said curved upper portion and having a second prong which extends from and below said curved upper portion, wherein a void is present between said first prong and said second prong;

b. a back strap which engages said neck strap, wherein said back strap is not present within said void between said first prong and said second prong; and, c. a breast cover which engages said neck strap.

3. An article of wearing apparel as described in claim 1, wherein said neck strap is a spring.

4. An article of wearing apparel as described in claim 2, wherein said neck strap is a spring.

5. An article of wearing apparel as described in claim 1, wherein said back strap is elastic.

6. An article of wearing apparel as described in claim 2, wherein said back strap is elastic.

7. An article of wearing apparel as described in claim 3, wherein said back strap is elastic.

8. An article of wearing apparel as described in claim 4, wherein said back strap is elastic.

9. An article of wearing apparel as described in claim 1, wherein said breast cover slidably engages said neck strap.

10. An article of wearing apparel as described in claim 2, wherein said breast cover slidably engages said neck strap.

11. An article of wearing apparel as described in claim 3, wherein said breast cover slidably engages said neck strap.

12. An article of wearing apparel as described in claim 4, wherein breast cover slidably engages said neck strap.

13. An article of wearing apparel, comprising:

a. at least one breast cover;

b. means for supporting said at least one breast cover, wherein said means for supporting at least one breast cover extends behind a neck of a wearer, and wherein said means for supporting at least one breast cover has a first prong which extends downwardly and a second prong which extends downwardly, wherein a void is present between said first prong and said second prong;

c. a back strap which engages said means for supporting at least one breast cover.

14. An article of wearing apparel as described in claim 13, wherein said cover slidably engages said means for supporting at least one breast cover.

15. An article of wearing apparel as described in claim 13, wherein said means for supporting at least one breast cover is a spring.

16. An article of wearing apparel as described in claim 14, wherein said means for supporting at least one breast cover is a spring.

* * * * *